United States Patent [19]

Fisher

[11] 4,135,231

[45] Jan. 16, 1979

[54] SURGICAL LIGHT ASSEMBLY

[75] Inventor: Kenneth J. Fisher, Erie, Pa.

[73] Assignee: American Sterilizer Company, Erie, Pa.

[21] Appl. No.: 795,645

[22] Filed: May 10, 1977

[51] Int. Cl.[2] ..... F21V 21/26

[52] U.S. Cl. ..... 362/269; 362/285; 362/297; 362/363

[58] Field of Search ..... 362/269, 277, 282, 283, 362/285, 288, 289, 297, 302-305, 396

[56] References Cited

U.S. PATENT DOCUMENTS

| | | | |
|---|---|---|---|
| 2,069,950 | 2/1937 | Greppin | 362/285 |
| 2,798,938 | 7/1957 | Jewell | 362/401 |
| 3,348,036 | 10/1967 | Bodian et al. | 362/285 |
| 3,395,272 | 7/1968 | Nicholl | 362/305 |
| 3,446,952 | 5/1969 | Sitter et al. | 363/285 X |
| 3,486,019 | 12/1969 | Bryant et al. | 362/294 |
| 3,560,728 | 2/1971 | Atkin | 362/294 |
| 3,634,675 | 1/1972 | Madsen et al. | 362/303 |
| 3,832,539 | 8/1974 | Oram | 362/804 X |
| 3,886,350 | 5/1975 | Katsukuru et al. | 362/287 |
| 4,032,771 | 6/1977 | Ilzig | 362/294 X |
| 4,037,096 | 7/1977 | Brendgord | 362/294 |

FOREIGN PATENT DOCUMENTS

| | | |
|---|---|---|
| 2348347 | 9/1972 | Fed. Rep. of Germany. |
| 974128 | 12/1941 | France. |
| 375943 | 7/1932 | United Kingdom. |

*Primary Examiner*—Peter A. Nelson

*Attorney, Agent, or Firm*—Shanley, O'Neil and Baker

[57] ABSTRACT

A surgical light assembly employs three fixed, coaxially-arranged curved reflectors with a single movable light source mounted for limited movement along the axis of the reflectors to focus the light. The light source and at least the reflective surfaces of two of the reflectors are enclosed so that convective currents over these surfaces are precluded. The light is cooled by a heat sink mounted in heat transfer relation with the light source, with the heat sink having a major surface exposed to atmosphere to dissipate heat. Glare is minimized by precluding direct viewing of the light source from outside the light assembly.

27 Claims, 7 Drawing Figures

FIG.4
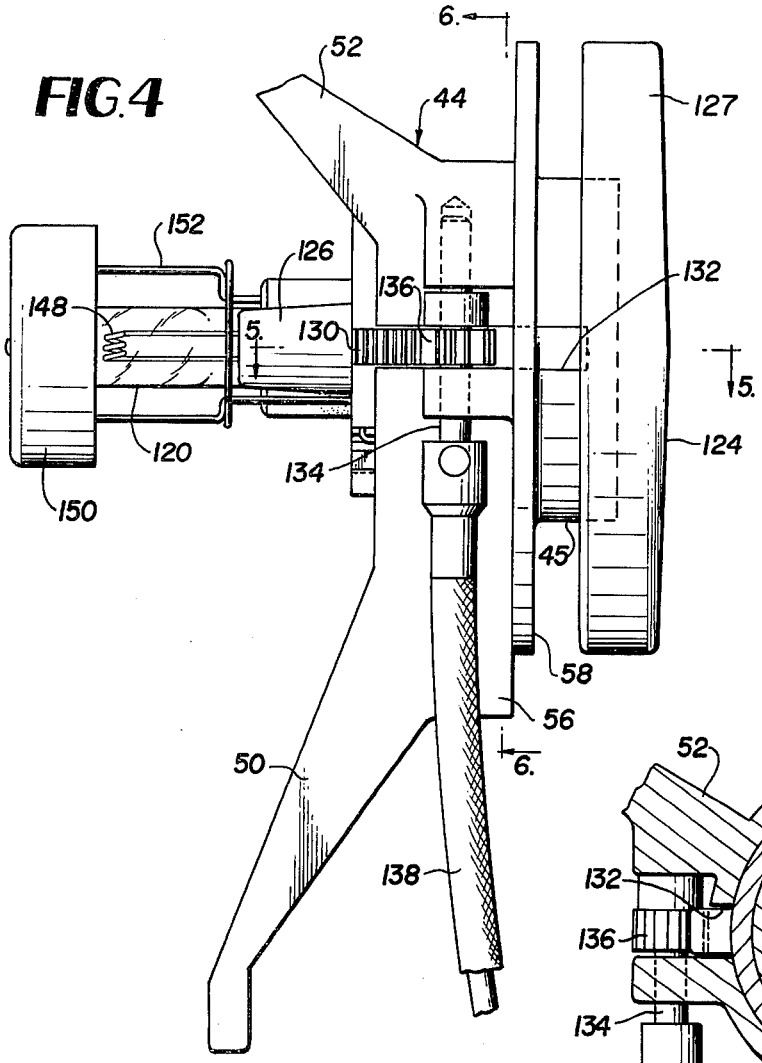
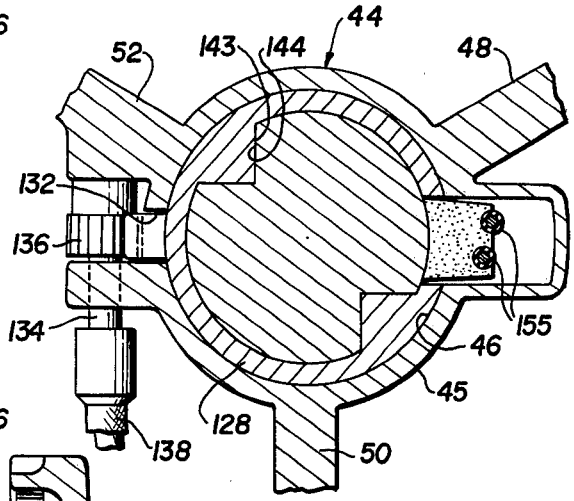
FIG.6
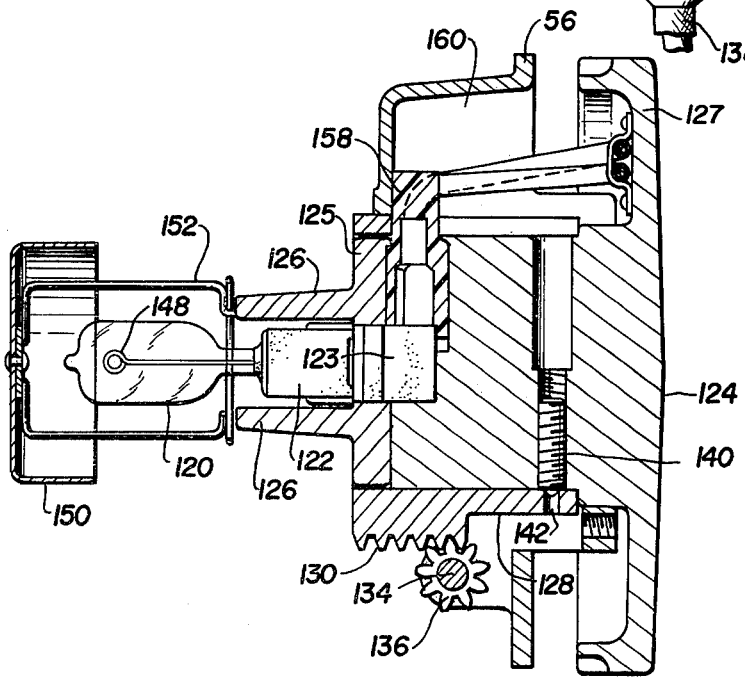
FIG.5

SURGICAL LIGHT ASSEMBLY

This invention relates to lighting apparatus, and more particularly to a surgical luminaire having improved focussing, light-shielding, and cooling properties.

The stringent requirements for proper and adequate lighting in the modern-day operating room have resulted in a continuing effort to improve the lighting apparatus used in such environments. Prior efforts generally have followed the approach of providing bigger lighting fixtures and increased light intensities, with the result that many such lighting devices on the market today are extremely large, heavy devices. Further, the high-intensity light source or sources used in such devices generate excessive heat and produce substantial glare, and generally are not completely shielded from direct or indirect view from outside so that operating room personnel may have to consciously avoid looking at the lights to thereby avoid temporary sight impairment during surgery. Inability to adequately focus the light from these prior art devices has generally resulted in the high-intensity illumination of an area much greater than necessary for surgical procedures.

The high wattage required for the prior art lights has generally required some provision to be made for cooling the assembly, both to make it possible to safely handle the light for focussing and the like, and to protect the structure from heat damage. This has frequently been accomplished by providing for air flow through the light structure, over and around the light source, with the air thus heated being discharged into the operating room at the back of the light. Nevertheless, substantial heat radiation has often been experienced by operating room personnel, frequently producing unpleasant working conditions or placing an excessive burden on operating room air conditioning and filtering systems.

While convection cooling may be more or less effective in cooling surgical lights, it frequently creates other problems in that dust particles are carried into the light assembly and collect on reflectors, light sources, and the like, making it necessary to disassemble the structure for cleaning at frequent intervals. This not only is a time-consuming task, but also may result in damage to the delicate reflective surfaces.

In overcoming the objections to and disadvantages of the prior art surgical lights discussed above, an important feature of the present invention resides in providing a surgical light assembly which employs a relatively low-intensity light source in combination with a system of fixed, curved reflective surfaces and light-shielding and filtering means which provide the necessary illumination more efficiently and without objectionable shadows. Glare is substantially reduced, and the possibility of emission of light rays directly from the light source is substantially eliminated. Heat radiation from the light is greatly reduced while light-color balance is maintained by the use of reflectors and filters. The light source is cooled by a heat sink having a radiation surface exposed directly to the atmosphere at the back of the light so that convection currents through the light assembly can be eliminated. The light can easily and quickly be relamped, i.e., the light source removed and replaced, from the rear of the light head assembly without use of tools and without disturbing the fixed relationship of the reflective surfaces or exposing the sealed reflective surfaces to contamination. The unique arrangements of the fixed curved reflectors results in an extremely compact, thin light assembly which is light in weight and is easy to clean and maintain. This fixed reflector arrangement, utilizing a reflector configuration which concentrates the light rays and focusses them into a relatively small but variable area forward of the luminaire, or light head, is made possible by the novel light source mounting structure.

An important contribution of the present invention is achieved by the effective utilization of a light source heat sink which removes heat directly to the back exterior portion of the luminaire without interfering with the ability to focus the light. Where the heat sink concept has been utilized in the prior art, e.g. U.S. Pat. No. 3,348,036, it has generally been necessary to rely on a finned structure and/or internal, channelled convection currents to dissipate the heat from the sink.

Other features and advantages of the surgical light according to the present invention will become more apparent from the detailed description contained hereinbelow, taken in conjunction with the drawings, in which:

FIG. 4 is a fragmentary view, on an enlarged scale, taken on line 4—4 of FIG. 2;

FIG. 5 is a sectional view taken on line 5—5 of FIG. 4;

FIG. 6 is a sectional view taken on line 6—6 of FIG. 4; and

Figure 1:
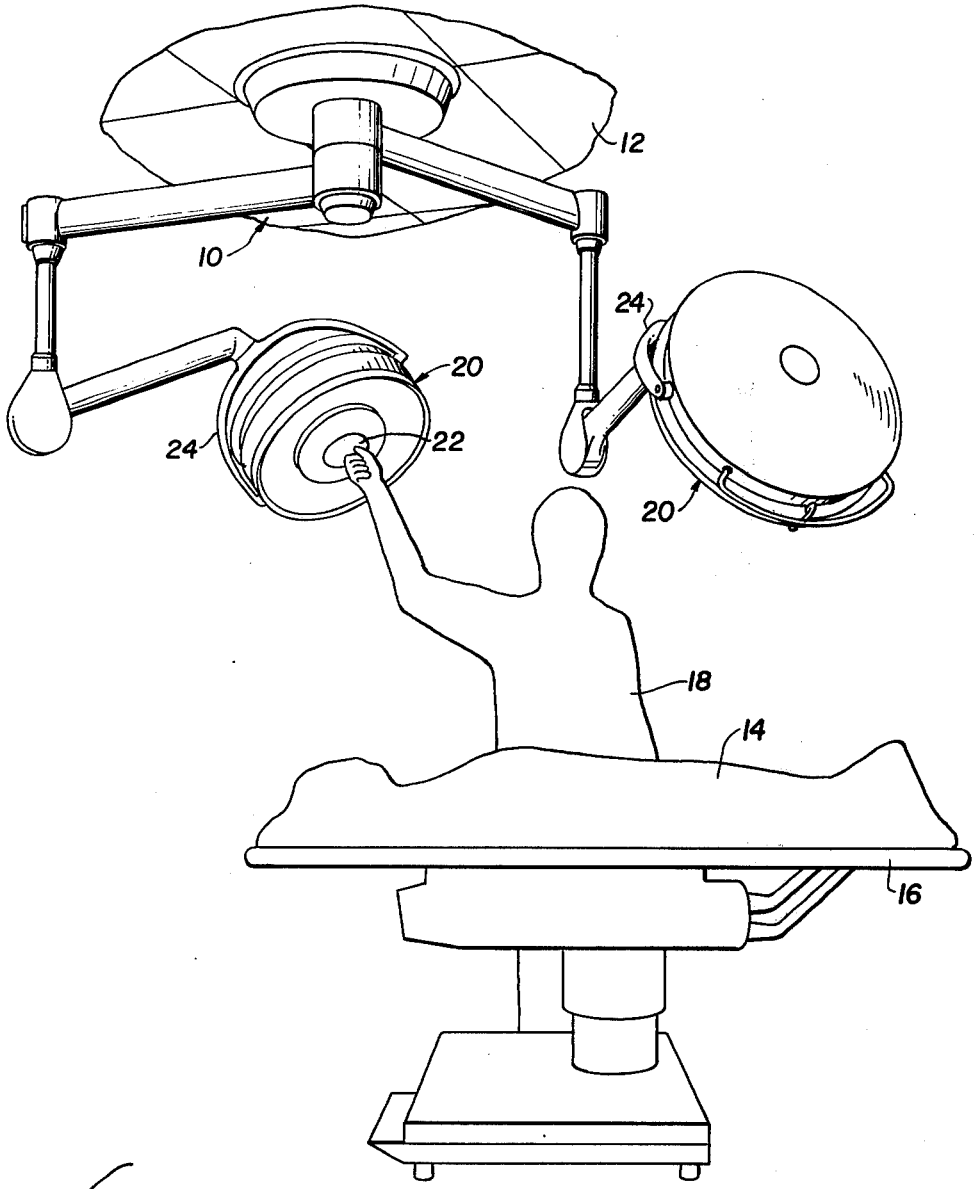
FIG. 1 is a perspective view schematically illustrating the invention in use in an operating room environment.

In the surgical environment of FIG. 1, a two-unit surgical light according to the present invention is indicated generally by the reference numeral 10 and illustrated as being suspended from ceiling 12 above a patient 14 on an operating table 16. A member 18 of the surgical team is shown adjusting the position of one of the illuminators, or light heads, 20, utilizing a sterile handle 22 which projects forwardly from the front, or clean side, of the light assembly. The light head 20 is preferably supported for pivotal movement about a transverse axis by a yoke 24 which, in turn, is supported for rotation about an axis extending substantially perpendicular to the transverse axis of the light head, thereby providing a universal mounting enabling the light to be positioned in the desired orientation relative to the patient.

Figure 2:
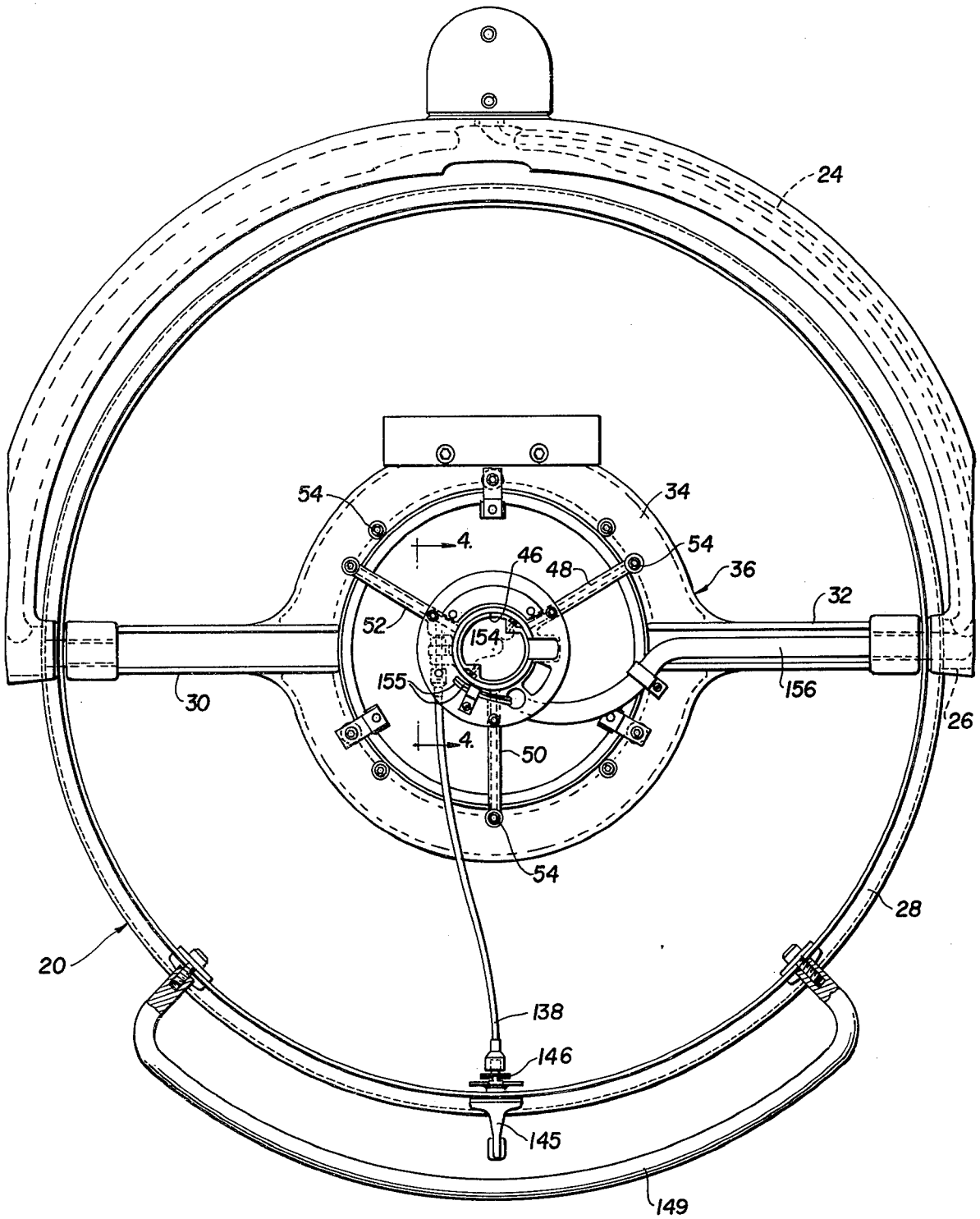
FIG. 2 is a plan view of the back of the light assembly according to the invention, with portions broken away and certain parts removed, to more clearly show other parts.

As seen in FIG. 2, the light head 20 is supported on yoke 24 by a pair of tubular pin members (not shown) which project inwardly through outer housing, or cover, 28 to engage and support a pair of arms 30, 32 which project outwardly in opposite directions from the central ring-shaped body 34 of a support yoke 36. An annular filter housing and reflector support member 38 is mounted on and projects forwardly from the ring-shaped body 34 and is retained thereon by a plurality of bolts 40. The inner peripheral portion of a ring-shaped concave reflector 42 (FIG. 3) is rigidly clamped between the annular member 38 and yoke body 34, with the reflector extending outwardly and forwardly, i.e., in the direction of projection of light from the light head 20, from the filter support.

A focus support member 44 is also rigidly mounted on the yoke ring 34. Focus support 44, as well as the support yoke 36 and annular member 38, are each preferably integrally formed, as by die casting, from a metal such as aluminum having a relatively high coefficient of thermal conductivity. These elements provide a strong yet lightweight frame structure which rigidly supports all the components of the light head.

The focus support 44 has a central hub portion 45 having a cylindrical bore 46 extending therethrough. Hub 45 is supported by this radially outwardly extending legs 48, 50, 52 which are rigidly secured to the yoke ring 34 as by bolts 54. A radially outwardly extending flange 56 integrally formed on the focus support hub 45 defines a ledge 58 which provides support for an inner flange portion 60 of a spun aluminum outer cover 62. Outer cover 62 is rigidly mounted on ledge 58 by screws 64 extending through flange 60, thereby providing for direct heat transfer between the focus support hub and the outer cover.

The outer cover 62 terminates at its outer periphery in a forwardly extending annular skirt portion 66 which extends to a position adjacent the outer, rolled peripheral edge 68 of reflector 42. The terminal edge 70 of the skirt 66 is joined with and sealed to the rolled edge 68 by a molded resilient sealing strip 72. Thus, cover 62 and reflector 42 are spaced from one another a substantial distance, with the space therebetween being substantially open and unobstructed so that hot spots, or heat concentrations, are effectively avoided.

The annular member 38 has three inwardly projecting lugs 74 formed thereon at spaced intervals around its inner periphery. The lugs 74 are contoured to engage and provide both radial and axial support for the beaded outer peripheral edge 75 of a parabolic reflector 76. A number of pressure pads 77 are formed on the outer convex, non-reflecting surface of reflector 76. Pressure pads 77 are each engaged by a resilient block 78 supported, as by screws 79, 80 and spring clips 81, on the rearwardly facing surface of the ring 34. Thus, the lugs 74 provide three-point support for the parabolic reflector 76, with the resilient blocks 78 retaining the reflector in contact with the lugs, so that stresses in the reflector due to thermal expansion and contraction are minimized. The parabolic reflector 76 is a cold reflector, i.e., one which reflects light within the visible range while absorbing and transmitting infrared light. Heat is therefore directed toward the back of the light head assembly through the reflector 76, while the useful, visible light is reflected toward the front. The substantial spacing between the cover 62 and the reflector 42 enables the wide distribution, or scattering, of the infrared light so that it does not excessively heat any part of the structure.

The lugs 74 also support, on their forwardly directed surfaces, a circular light filter plate 82 and a light diffuser plate 83. Plates 82, 83 are retained in surface-to-surface contact with one another and on the lugs by metal clips 84 and bolts 85. The filter 82 absorbs and reflects infrared light while transmitting light within the visible range. Diffuser 83 acts to diffuse light passing through the filter 82, thereby assuring against shadows or bright spots in the area illuminated. While filter 82 and diffuser 83 are shown as separate elements, they may be combined, if desired, by providing a diffusion surface on the forward side of the filter plate.

A cylindrical dust shield 86 having an inwardly directed, integrally formed flange 87 on one end is mounted on annular member 38 by a plurality of screws 88 extending through the flange 87. Dust shield 86 is substantially transparent and preferably formed from a synthetic resin, or plastic, material having a scratch-resistant outer surface which is also resistant to cleaning solutions normally used to clean non-sterilized equipment in operating rooms. All light from the apparatus must pass through this cylindrical dust shield in its path to the reflector 42.

A handle support frame 89 is mounted by screws 90 on the end of the dust shield opposite the flange 87. Frame 89 extends radially inward and has mounted thereon a reflector support 92 which, in turn, supports a generally conical reflector 94 in fixed coaxial relation to reflectors 42 and 76 and in position to reflect light laterally onto reflector 42. Reflector 94 is circular in axial cross-section and flares outwardly and forwardly from its rearwardly directed end 95 which is mounted on the reflector support 92. The outwardly directed reflective surface 96 is a surface of revolution generated by rotating an outwardly concave curve about the axis of symmetry.

A handle support 97, preferably formed from synthetic resin or other material of relatively low thermal conductivity, is mounted on the reflector support 92 as by a screw 98. A spun metal light positioning handle 22 is threadably mounted on the handle support 97, with the handle projecting outwardly from the light assembly in coaxial relation with the reflector 94 to provide easy access for adjusting the position of the light. Handle 22 has a radially extending, integrally formed flange 100 on its inner end, with the flange 100 being large enough to provide a shield to prevent the hand of a person adjusting the light from coming into contact with a non-sterile portion of the light assembly. Handle 22 can readily be removed from the handle support for sterilizing.

Also mounted on the reflector support 92 is a combination light shield and cover plate 102 which overlies the handle support frame 89. The plate 102 has a rearwardly extending peripheral skirt portion 104 which overlies and extends in outwardly spaced relation to the forward end of the dust shield 86, with an inwardly extending flange 106 extending radially inward from the skirt 104 to engage the outer periphery of the dust shield. This flange 106 is positioned relative to the conical reflector 94 and the outer edge of the reflector 42 so as to act as a light shield preventing the passage of light rays through the dust shield except in a path which will strike the reflector 42. The cover plate 102 cooperates with the dust shield 86, the annular member 38, reflector 42, and rear cover 62 to effectively seal the interior of the light head assembly to prevent convection currents therethrough and to exclude dust particles.

The transparent plastic dust shield 86 provides the sole support for the reflector 94, adjustment handle 22 and the light shield and cover plate 102. This arrangement eliminates shadows or blind spots which could result from internal structural supports.

A second light shield assembly 108 is positioned within the enclosure of the light assembly and supported between the dust shield 86 and the annular member 38. The light shield assembly 108 is constructed from an angle member 110 and a channel 112 assembled together to provide a rigid, lightweight annular ring having inner and outer light-limiting edges 114, 116, respectively, which are accurately positioned and clearly defined to limit the escape of light to those rays which strike the reflector 42 at an angle to be reflected onto the area to be illuminated. The plate 102 and light shield 108 cooperate to essentially eliminate scatter light, i.e., light other than that focussed onto the area to be illuminated. Further, these elements are spaced from one another, along the axis of the fixed reflectors, and cooperate to shield all but a relatively short axial length, or narrow annular band, of the cylindrical dust shield 86. All of the light escaping the enclosed structure must be reflected from the external surface of reflector 94 through this narrow band onto the substantially greater surface of reflector 42. This is accomplished by concentrating the light rays, in a crossing pattern, in the area of the exposed narrow annular band of the dust shield in a manner similar to that disclosed in FIGS. 3 and 4 of allowed U.S. patent application Ser. No. 496,166, assigned to the assignee of this application.

Light from the light head assembly is produced by a light source which preferably is in the form of a small metal halogen or other suitable light bulb 120 supported on the common axis of reflectors 42, 76, and 94 and within the parabolic concavity of reflector 76. As illustrated, the bulb 120 may have its base 122 plugged directly into a socket 123 carried by heat sink 124 and retained thereon by metal mounting ring 125. Ring 125 is mounted directly on and forms a part of heat sink 124. The body of heat sink 124 is in the form of a relatively large mass of metal such as aluminum having a relatively high coefficient of thermal conductivity to enable it to absorb heat directly from the base 122 of the light bulb 120. The heat sink 124 has a radially enlarged flange or cap 127 on its outer end, with the cap 127 having its outer surface forming, in effect, a continuation of the outer surface of the rear cover 62.

Heat sink 124, with bulb 120 mounted thereon, is supported in a guide sleeve 128, which, in turn, is mounted for sliding movement within the cylindrical bore 46 of focus support 44. As seen in FIGS. 4–6, manually operable actuating means are provided for adjusting the sleeve and the structure supported therein along the cylindrical bore. This actuating means includes a short axially extending gear rack 130 formed on the outer surface of guide sleeve 128, with the rack 130 projecting outwardly through an axially extending slot 132 in central hub 45. A stub shaft 134 is journalled on the focus support 44 and supports a pinion gear 136 in position to mesh with the rack 130. Shaft 134 is connected to one end of a flexible drive shaft 138 for rotation thereby to drive the guide sleeve 128, and the heat sink and light bulb carried thereby, along the axis of the parabolic reflector 76. A resilient ball detent assembly 140 carried by the heat sink 124 is positioned to engage a slot 142 in guide sleeve 128 to releasably retain the guide sleeve and heat sink in assembled relation.

The inner surface of the guide sleeve 128 is preferably in direct heat transfer contact with the adjacent surface of the heat sink, and the external surface of the guide sleeve is in direct heat transfer contact with the internal surface of cylindrical bore 46 so that a portion of the heat absorbed by the heat sink may also be transferred to the guide sleeve and into the focus support, as well as to the external cover 62, by conduction. Inwardly directed tongues 143 on the inner surface of sleeve 128 cooperate with grooves 144 on the adjacent surface of the heat sink to prevent relative rotation therebetween and to assure assembly in the same relative orientation each time the unit is disassembled. To increase heat transfer from the base of the bulb to the heat sink, the retaining ring 125 can have integrally formed extensions 126 disposed closely adjacent two opposite sides of the rectangular base 122 of the bulb, leaving the remaining two sides exposed for easy access to facilitate removing and replacing the bulb, a procedure generally referred to as relamping.

Flexible shaft 138 has its other end connected to a focussing handle 145 mounted on the outer periphery of the skirt portion 66 of outer cover 62. Preferably, shaft 138 and handle 145 are connected through a resilient detent, or stepping switch assembly 146 which provides a readily discernible positioning guide for indicating the location of the heat sink and the light source and consequently an indication of the focus of the light assembly. This stepped positioning of the focus handle enables focussing by feel with minimum disruption of concentration during a surgical procedure.

Figure 3:
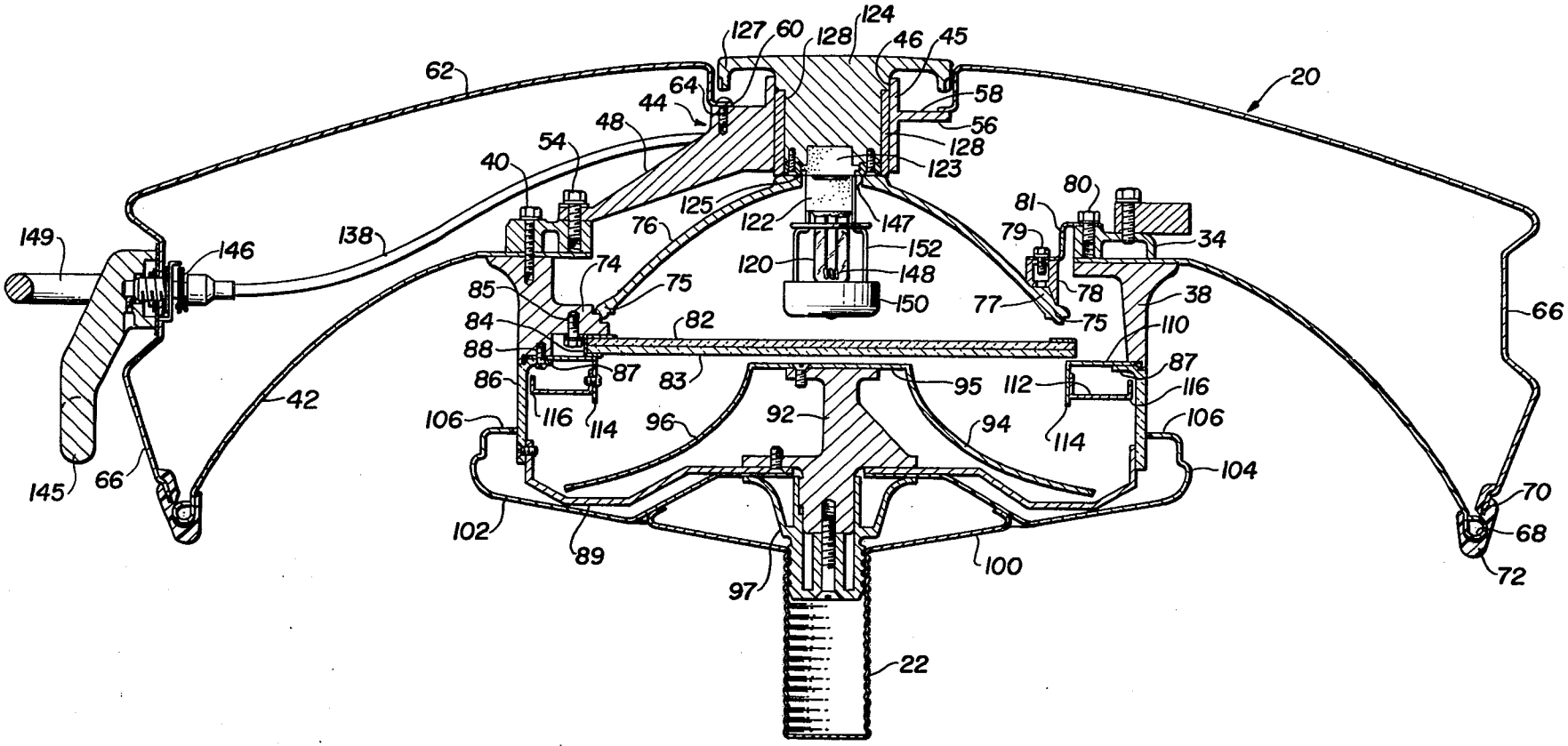
FIG. 3 is a sectional view taken on line 3—3 of FIG. 2.

As most clearly seen in FIG. 3, the light bulb 120 projects through a central opening 147 in reflector 76. The bulb 120 is of the type having a relatively small, compact filament 148 providing, for practical purposes, a point source within the bulb envelope so that movement of the bulb along the parabolic axis of reflector 76 affects the focus of the light assembly, enabling easy adjustment of the area illuminated and intensity of illumination by positioning the handle 145. An elongated, non-sterile light head positioning handle or rod 149 is also mounted on the skirt 66, to facilitate positioning the light head by non-sterile personnel, thereby avoiding possible contamination of the sterile handle 22. The handle 149 extends outwardly from and along a segment of the skirt 66 in position to engage the yoke 24 and prevent the light head from being rotated completely about the axis of arms 30, 32. Also, the end portions of handle 149 first engage the yoke 24, so that the focussing handle 145 is protected and is always accessible.

To further reduce the amount of infrared contained in the light which is emitted from the front of the light head assembly, a shallow, generally cylindrical or cup-shaped retro-reflector 150 having a reflective inner surface is mounted on the guide sleeve 128 by slender support rods 152 and screws 154 (see FIG. 2). The support rods 152 extend through the opening 147 in reflector 76, in closely spaced relation to the ceramic base 122 of the light bulb 120 so that the retroreflector moves axially with the light bulb upon focussing adjustment. The light filament 148 of the bulb is positioned centrally of and closely adjacent the open top of the retroreflector so that light rays emitted directly from the filament in the forward direction are reflected back toward the cold parabolic reflector 76. Thus, essentially all light passing through the filter 82 and diffuser 83 and striking the reflector 94 has been reflected by the cold reflector 76 and also filtered through the filter 82 so that infrared light has been effectively filtered out before the light can escape from the assembly.

The infrared light transmitted through the cold reflector 76 is absorbed by structural members of the light head such as the inner surface of the back cover 62, the focus support 44, and the inner support yoke 36. Heat from the cover 62 may be radiated from the back of the light, or removed from the cover by convection currents flowing over the outer peripheral and back surface of the light. Similarly, heat absorbed by the heat sink from the base of the bulb may be dissipated from the back of the light, through the enlarged flange 127 both by radiation and convection. However, since the light bulb is essentially sealed within the enclosure of the light head assembly, convection currents through the assembly are eliminated and the entire optical system within the enclosure remains clean and uncontaminated, thereby eliminating the necessity for frequent cleaning of the interior of the light by maintenance personnel. The external surface is substantially smooth and can readily be cleaned by merely wiping down the exposed surfaces with an approved cleaning solution. The open frame support structure within the enclosure eliminates hot spots near the light source. At the same time, this structure assists in the removal of heat, thereby prolonging the lift of the bulb.

Figure 7:
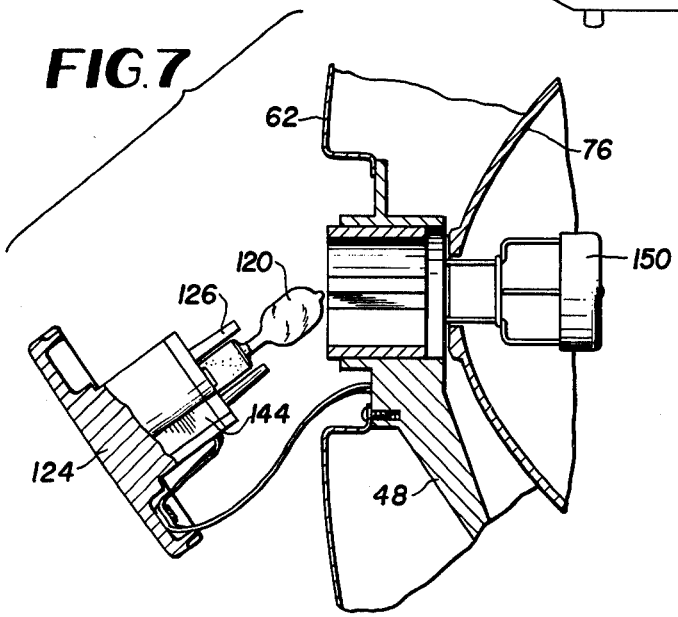
FIG. 7 is a fragmentary view, partially in section, showing the heat sink and light source in position for relamping.

Electrical current is supplied to the light bulb through conductors or wires 155 extending through conduit 156 from the hollow interior of the arms of yoke 24 and the overhead support assembly. The ends of the wires 155 are fixed in the lamp socket 123 and the socket is secured and sealed by a suitable high temperature potting material 158. The wires 155 extend upwardly through a channel 160 of the central hub 45 of the focus support and are coiled around the heat sink, beneath the overhang of the flange 127 to enable the heat sink and light bulb to be withdrawn from the guide sleeve 128 to provide access to the light bulb as shown in FIG. 7. This is accomplished by rotating the pinion 136 in a clockwise direction as viewed in FIG. 5 to thereby project the heat sink flange rearwardly beyond the external surface of the back cover 62. The flange 127 is then manually grasped and pulled rearwardly to disengage the ball detent assembly 140 from the slot 142 in the guide sleeve, permitting the bulb to be withdrawn through the central opening 147 in the parabolic reflector 76. However, the retroreflector, being mounted on the guide sleeve, remains within the light assembly when the light bulb and heat sink are removed. This enables very quick relamping, from the rear of the light, by unskilled personnel, without the disruption or contamination of the optics or other internal parts of the light assembly.

As previously indicated, reflector 42 curves outwardly and forwardly from its inner peripheral mounting to terminate in an outer edge 68. The laterally-directing reflector 94, which has a maximum diameter less than the minimum diameter of the reflective surface of reflector 42, is mounted within the axial limits of reflector 42. Also, reflector 76 is mounted with the open forward end forward of the central opening in reflector 42, with the vertex of the reflector extending rearwardly through the opening. This makes possible the very compact arrangement of the three reflectors which focus the light onto a relatively small, well-defined area. The annular light beam from reflector 42 converges, with the light rays merging and crossing within the focussed beam to greatly reduce shadows.

By mounting the light bulb, per se, for movement along the common axis of the three curved reflectors, the light can readily be focussed while maintaining all of these reflectors in a fixed position. Further, by concentrating the useable light in a manner to be focussed directly on the area to be illuminated, thereby substantially eliminating scatter light which serves no useful purpose, a relatively small light source may be employed. In tests of the light in hospital operating rooms during actual surgical procedures, it has been found that a metal halogen light having a rating of 200 watts at 30 volts produced ample illumination for all surgical procedures, and in fact was frequently operated at less than maximum rated voltage. This low power consumption not only makes the light more economical to operate, but also reduces the amount of heat generated. The effective infrared filter system, coupled with the novel heat sink structure, concentrates this heat in the back of the light where it is dissipated into the atmosphere.

A production model light assembly according to the present invention has been subjected to extensive laboratory testing. The complete light head 20 weighed only approximately 20 pounds, and the reflector 42 had a maximum diameter of 22 inches. The total thickness of the unit, measured along the common axis of the reflectors, from the back of rear cover 62 to the forward, outer rim 68 of reflector 42 was only approximately 8½ inches. A metal halogen light bulb having a 200 watt rating at 30 volts was used. The focus handle detent 146 had three positions to provide small, medium and large circular patterns which were 4", 6", and 8¾", respectively, in diameter, measured in a focal plane 42 inches in front of the outer rim of reflector 42. The intensity of the light at the center of these patterns, for various voltages, was measured as follows:

| | Light intensity in Ft. Candles | | |
|---|---|---|---|
| Voltage | Small | Medium | Large |
| 22 | 3,000 | 1535 | 695 |
| 23 | 3,500 | 1870 | 809 |
| 24 | 4,000 | 2165 | 980 |
| 25 | 4,600 | 2525 | 1098 |
| 26 | 5,279 | 3700 | 1264 |
| 27 | 6,033 | 3252 | 1301 |
| 28 | 6,712 | 3700 | 1589 |
| 29 | 7,500 | 4159 | 1804 |
| 30 | 8,300 | 4680 | 2072 |

The maximum intensities listed above for the center of each pattern decreased to substantially zero outside a nine-inch diameter pattern. The intensity variation is relatively slight near the center of the patterns, then increases rapidly. The point at which the rapid decrease in intensity occurs varies with the focal position of the bulb, and is at a greater distance from the center when the bulb is positioned for a larger pattern. The size of the pattern is determined by the point at which the light intensity drops to 20 percent of the maximum at the center of the pattern. In each case, this 20 percent level coincides very closely with the point at which the sharp decrease in intensity occurs.

A further and important advantage of the elimination of scatter light is the substantially complete elimination of glare. The light can be viewed from any position outside of the relatively small focussed light pattern directly in front of the light head without seeing the light source, either directly or indirectly. Thus, the surgeon can locate the light in the position most advantageous for the surgical procedure with complete confidence that the sight of other members of the team is not being impaired.

Tests to determine the heat level of light from the above-described production light were also conducted. It was determined that, for a median intensity of 4,000 foot candles, the heat was only 13,000 microwatts per sq. cm. This very low level of heat is hardly discernible to the naked skin and contrasts greatly with the heat levels common in prior art surgical lights of this type.

While the preferred embodiment of the invention has been described, it is understood that various modifications and changes may be employed without departing from the invention. Thus, for example, while each of the main reflectors in the light head have been illustrated as being compound curved reflectors, it is believed that one or more might be a simple curved structure, for example, a conical reflector, with the other reflectors being appropriately modified to provide the desired illumination pattern for the various focus positions of the movable light source. Accordingly, while a preferred embodiment has been described in detail, I wish it understood that I do not intend to be restricted solely thereto, but rather that I do intend to include all embodiments thereof which would be apparent to one skilled in the art and which come within the spirit and scope of my invention.

I claim:

1. A light assembly comprising, in combination, a first reflector having a substantially parabolic concave reflective surface, the first reflector being a cool reflector capable of transmitting infrared radiation while reflecting essentially all visible light, a second reflector having an annular divergent external reflective surface, support means mounting the first and second reflectors in fixed spaced coaxial relation to one another with their respective surfaces in generally opposed relation, a third reflector having an annular divergent internal reflective surface, such third reflector being mounted on the support means in fixed coaxial relation with and having its reflective surface extending in radially outwardly spaced relation to the first and second reflectors, the reflective surfaces on the first and third reflectors being directed in the same general axial direction, a light source, an opaque light shield having a reflective surface thereon, light shield support means mounting the opaque light shield in fixed relation to the light source and between the light source and the second reflector with the reflective surface facing the light source to reflect back toward the first reflector and the light source at least the major portion of the light rays emitted in the direction of the second reflector by the light source, and mounting means supporting the light source and the opaque light shield within the concave portion of the first reflector on the common axis of the three reflectors, the mounting means including actuating means operable to move the light source and the light shield along the common axis to focus the light on an area to be illuminated.

2. The invention as defined in claim 1 further comprising fixed light shield means mounted on the support means and blocking all direct view of the light source from without the light assembly, the light shield means being positioned relative to the light source and the three reflectors to block the escape of all light rays emitted from the light source which are not reflected by at least the second and third reflectors so that the light shield means blocks indirect view of the light source from all positions outside the light assembly except directly in front of the light assembly.

3. The invention as defined in claim 2, wherein the first reflector is a cool reflector capable of transmitting infrared light and reflecting essentially all visible light of the spectrum, whereby at least a major portion of the infrared radiation is eliminated from the light reflected by the third reflector onto the area to be illuminated.

4. The invention as defined in claim 1, wherein the light assembly includes enclosure means enclosing the light source, the opaque light shield, and the first and second reflectors to thereby preclude convective currents through the light assembly.

5. The invention as defined in claim 4, further comprising, a hot mirror filter, and filter support means mounting the filter within the light transversely of the common axis of the three reflectors with the first reflector and light source on one side thereof and the second reflector on the other side thereof, the hot mirror reflector being capable of reflecting infrared light and transmitting essentially all visible light of the spectrum to further reduce the infrared radiation emitted from the light and reflected onto the area to be illuminated.

6. A light assembly comprising, in combination, a first reflector having a substantially parabolic concave reflective surface, a second reflector having an annular divergent external reflective surface, support means mounting the first and second reflectors in fixed spaced coaxial relation to one another with their respective reflective surfaces in generally opposed relation, a third reflector having an annular divergent internal reflective surface, such third reflector being mounted on the support means in fixed coaxial relation with and having its reflective surface extending in radially outwardly spaced relation to the first and second reflectors, the reflective surfaces on the first and third reflectors being directed in the same general axial direction, a light source, mounting means supporting the light source within the concave portion of the first reflector on the common axis of the three reflectors, the mounting means including actuating means operable to move the light source along the common axis to focus the light on an area to be illuminated, enclosure means enclosing the light source and the reflective surfaces of the first and second reflectors, and a heat sink in the form of a mass of metal having a relatively high coefficient of thermal conductivity, the mounting means supporting the light source on and in heat-transfer relation with the heat sink, with the heat sink extending through the enclosure means and having a surface exposed to atmosphere externally of the enclosure for dispersing into the atmosphere heat absorbed from the light source, the actuating means is operable to move the heat sink and the light source mounted thereon along the common axis of the reflectors.

7. The invention as defined in claim 6, wherein the heat sink includes a generally cylindrical body portion having the light source mounted on one end and flange means on its other end, the flange means providing an enlarged surface exposed to the atmosphere for the purpose of increasing heat dissipation.

8. The invention as defined in claim 6, further comprising, an opaque light shield having a reflective surface thereon disposed between the light source and the second reflector with the reflective surface facing the light source to reflect back toward the first reflector and the light source at least a major portion of the light rays emitted by the light source in the direction of the second reflector, and means mounting the opaque light shield for movement along the common axis of the reflectors with the heat sink and light source.

9. The invention as defined in claim 8, wherein the actuating means includes rack-and-pinion means manually operable to selectively position the heat sink, light source, and the opaque light shield relative to the first reflector.

10. The invention as defined in claim 9, wherein the actuating means includes an annular sleeve movable by the rack-and-pinion means, and wherein the heat sink and light source are telescopingly received in the sleeve, the heat sink and sleeve including cooperating means releasably retaining the heat sink and light source within the sleeve.

11. The invention as defined in claim 8, wherein the first reflector is supported only in the area of its outer periphery and has a central opening therein, the light source and means supporting the opaque light shield extending through and movable within the opening upon operation of the actuating means to focus the light, the central opening in the first reflector being of sufficient size to avoid contact with the light source and opaque light shield mounting means to avoid direct heat transfer therebetween.

12. The invention as defined in claim 8 wherein the heat sink includes a generally cylindrical body portion having the light source mounted on one end and flange means on its other end, the flange means providing an enlarged surface exposed to atmosphere outside the enclosure to thereby increase its ability to dissipate heat to the atmosphere.

13. The invention as defined in claim 8, wherein the actuating means includes retaining means engaging and releasably retaining the heat sink on the actuating means, the retaining means being operable to permit withdrawal of the heat sink and light source from the enclosure means.

14. A light assembly comprising, in combination, a light source, first, second, and third curved reflectors, frame means mounting the first, second and third reflectors in fixed coaxial relation with the reflectors being arranged relative to one another to cooperate to reflect light from the light source onto an area to be illuminated, the first reflector having an internal, concave reflective surface, a heat sink in the form of a mass of metal having a high coefficient of thermal conductivity, heat sink mounting means supporting the heat sink for limited movement along the common axis of the reflectors, light source mounting means supporting the light source within the concavity of the first reflector and in heat-transfer relation with the heat sink, the light source being movable with the heat sink along the common axis of the reflectors to thereby focus the light reflected from the light source onto the area to be illuminated and enclosure means enclosing the light source and the reflective surfaces of the first and second reflectors, the heat sink extending through the enclosure means and having an enlarged surface exposed to atmosphere externally of the enclosure for dissipating heat to the atmosphere.

15. The invention as defined in claim 14, further comprising, an opaque light shield having a reflective surface thereon disposed between the light source and the second reflector with the reflective surface facing the light source to reflect back toward the first reflector and the light source at least a major portion of the light rays emitted by the light source in the direction of the second reflector, and means mounting the opaque light shield for movement along the common axis of the reflectors with the heat sink and light source.

16. The invention as defined in claim 14, wherein the support means includes actuating means operable to move the heat sink and light source along the common axis of the reflectors, the actuating means including means manually operable to selectively position the heat sink, light source, and opaque light shield at selective positions relative to the first reflector.

17. The invention as defined in claim 14, wherein the enclosure means includes light shield means completely blocking the light source from direct view from outside the light assembly, the light shield means being positioned to block light emitted from the light source which is not reflected by at least the second and third reflector.

18. The invention as defined in claim 17, wherein the light shield means, enclosure means and reflectors are arranged to prevent escape from the assembly of essentially all light which is not reflected by each of the first, second and third reflectors.

19. The invention as defined in claim 14, wherein the first reflector is a cool reflector capable of transmitting infrared light while reflecting essentially all visible light of the spectrum, whereby at least a major portion of the infrared radiation is eliminated from the light reflected by the third reflector onto the area to be illuminated.

20. The invention as defined in claim 19, further comprising, a hot mirror filter, filter mounting means supporting the filter transversely of the common axis of the three reflectors with the first reflector and light source on one side thereof and the second reflector on the other side thereof, the hot mirror reflector being capable of reflecting infrared light and transmitting essentially all visible light of the spectrum to further reduce the infrared radiation emitted from the light and reflected onto the area to be illuminated.

21. The invention as defined in claim 20, further comprising an opaque light shield disposed between the light source and the second reflector in position to reflect back toward the first reflector and the light source at least a major portion of the light rays emitted in the direction of the second reflector by the light source.

22. The invention as defined in claim 20, further comprising light diffuser means, and means mounting the light diffuser means between the first and second reflectors in position to diffuse all light reaching the second reflector.

23. A light assembly comprising, in combination, a light source, first, second, and third curved reflectors, frame means mounting the first, second, and third reflectors in fixed co-axial relation with the reflectors being arranged relative to one another to cooperate to reflect light from the light source onto an area to be illuminated, the first reflector having an internal concave reflective surface and being a cool reflector capable of transmitting infra-red light and reflecting essentially all visible light of the spectrum, a heat sink in the form of a mass of metal having a high coefficient of thermal conductivity, heat sink mounting means supporting the heat sink for limited movement along the common axis of the reflectors, light source mounting means supporting the light source within the concavity of the first reflector and in heat transfer relation with the heat sink, the light source being moveable with the heat sink along the common axis of the reflectors to thereby focus the light reflected from the light source onto the area to be illuminated, an opaque light shield having a reflective surface thereon, light shield support means mounting the opaque light shield between the light source and the second reflector with the reflective surface facing in the direction of the light source to reflect back toward the first reflector and the light source at least the major portion of the light rays emitted in the direction of the second reflector by the light source, said light shield support means supporting the opaque light shield for movement with the light source and the heat sink by the actuating means, a hot mirror filter, and filter support means mounting the filter transversely of the common axis of the three reflectors with the first reflector and light source on one side thereof and the second reflector on the other side thereof, the hot mirror reflector being capable of reflecting infra-red light and transmitting essentially all visible light of the spectrum to further reduce the infra-red radiation emitted from the light and reflected onto the area to be illuminated.

24. The invention as defined in claim 23 wherein said heat sink extends through the enclosure means and has a surface exposed to atmosphere externally of the enclosure for disbursing into the atmosphere heat absorbed from the light source.

25. The invention as defined in claim 24 further comprising a fixed light shield means mounted on the support means and blocking direct view of the light source from outside the light assembly, the light shield means being positioned relative to the light source and the three reflectors to block the escape of light rays emitted from the light source which are not reflected by at least the second and third reflectors.

26. The invention as defined in claim 25 further comprising light diffuser means, and means mounting the light diffuser means between the first and second reflectors in position to diffuse all light reaching the second reflector from the light source.

27. The invention as defined in claim 26 wherein the actuating means includes rack-and-pinion means manually operable to selectively position the heat sink, light source, and the opaque light shield relative to the first reflector.

* * * * *

UNITED STATES PATENT AND TRADEMARK OFFICE

CERTIFICATE OF CORRECTION

PATENT NO. : 4,135,231

DATED : January 16, 1979

INVENTOR(S) : Kenneth J. Fisher

It is certified that error appears in the above-identified patent and that said Letters Patent are hereby corrected as shown below:

Column 7, line 17, "lift" should read --life--.

Column 9, line 28, "respective", insert -- reflective --.

Column 11, line 47, a new paragraph should be started with the word "frame".

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*